United States Patent [19]

Tetzlaff et al.

[11] Patent Number: 4,627,897

[45] Date of Patent: Dec. 9, 1986

[54] PROCESS FOR THE ELECTROLYSIS OF LIQUID ELECTROLYTES USING FILM FLOW TECHNIQUES

[75] Inventors: Karl-Heinz Tetzlaff, Kelkheim; Dieter Schmid, Schwalbach; Jürgen Russow, Kelkheim, all of Fed. Rep. of Germany

[73] Assignee: Hoechst Aktiengesellschaft, Fed. Rep. of Germany

[21] Appl. No.: 692,306

[22] Filed: Jan. 17, 1985

[30] Foreign Application Priority Data

Jan. 19, 1984 [DE] Fed. Rep. of Germany ..... 3401637

[51] Int. Cl.[4] ..... C25B 1/00; C25B 3/00; C25C 1/00

[52] U.S. Cl. ..... 204/59 R; 204/60; 204/95; 204/98; 204/128; 204/129; 204/182.5

[58] Field of Search ..... 204/1 R, 59 R, 60, 95, 204/98, 128, 129, 182.5

[56] References Cited

U.S. PATENT DOCUMENTS

| | | | |
|---|---|---|---|
| 3,463,709 | 8/1969 | Russell | 204/60 |
| 3,893,897 | 7/1975 | Rzetzsch et al. | 204/98 |
| 4,065,367 | 12/1977 | de Nora | 204/128 |
| 4,118,305 | 10/1978 | Oloman et al. | 204/1 R |
| 4,256,551 | 3/1981 | Cliff et al. | 204/98 |
| 4,305,793 | 12/1981 | Broniewski | 204/98 |
| 4,315,805 | 2/1982 | Darlington et al. | 204/98 |
| 4,430,176 | 2/1984 | Davison | 204/284 |
| 4,457,813 | 7/1984 | Rogerr et al. | 204/78 |

*Primary Examiner*—Terryence Chapman

*Attorney, Agent, or Firm*—Connolly and Hutz

[57] ABSTRACT

This process, in which gas bubbles are formed in the electrolyte, is carried out in electrolytic cells which are non-partitioned or partitioned by at least one separator and in which at least one electrode is perforated. For this purpose, the electrolyte is caused to flow by means of gravity through the electrolytic cell in such a manner that a gas space is formed laterally to the main direction of flow of the electrolyte, both electrodes or the separators or one separator and the perforated electrode being wetted.

8 Claims, 16 Drawing Figures

PROCESS FOR THE ELECTROLYSIS OF LIQUID ELECTROLYTES USING FILM FLOW TECHNIQUES

The invention relates to a process for the electrolysis of liquid electrolytes with the formation of gas bubbles in the electrolyte in electrolytic cells which are non-partitioned or partitioned by at least one separator and in which at least one electrode is perforated.

A large number of electrolysis processes using non-partitioned electrolytic cells and electrolytic cells partitioned by separators are known, in which gas is liberated in the electrolyte. This invention relates to reducing the unfavorable effects of a bubble system of this type. In many of these processes, in accordance with the state of the art, the directly bonded electrodes are caused to dip vertically into the electrolyte liquid in order to achieve a compact design. This design is to be met with particularly in the case of partitioned electrolytic cells in which gas is evolved on the anode side and on the cathode side. However, the gas bubbles interfere with the electrolysis process in a multitude of ways. The following should be mentioned particularly:

increasing the ohmic voltage drop, blocking electrodes and separators, non-uniform current loading between the top and the bottom, pressure fluctuations between the anolyte compartment and the catholyte compartment if the gas content varies in partitioned electrolytic cells, vibration caused by mass displacement of large bubbles in the two-phase flow, high-frequency pressure fluctuations caused by the two-phase flow at the narrowed outlet apertures, and pressure fluctuations caused by variations in the current loading.

The two-phase flow has an adverse effect not only on the electrochemical conditions, but also on the strength and service life of the components.

An electrolysis process, in electrolytic cells partitioned by separators, in which the electrolyte is passed under gravity as a film over the surface of an electrode is known from French Patent Application No. 2,514,376. Any gas which may be formed can escape through the perforations in the expanded metal electrode located above this. It is not explained how the process is to be carried out for industrial electrolysis processes in which gas is evolved.

Attempts to mitigate the interference described have also been made by means of a number of other measures. The following measures are known:

reducing the height, using perforated electrodes, enlarging the rearward space downstream of the electrode, and recirculating the electrolyte in conjunction with a gas separator.

However, these measures increase the equipment costs and the constructional volume and only mitigate some of the disturbances mentioned.

The object of the invention therefore consists in eliminating the hydrostatic and hydrodynamic effects, reducing the effect of the height of construction on the gas bubble content of the electrolyte and diminishing the rearward space of the electrode.

A process is therefore suggested, in which at least one perforated electrode is used and which comprises causing the electrolyte to flow by means of gravity through the electrolytic cell in such a way that a gas space is formed laterally to the main direction of flow of the electrolyte.

In one embodiment of the process the electrolyte is caused to flow in such a manner that both electrodes, the perforated electrode and a separator or the separators are wetted.

The electrolyte can also be caused to flow partly through the separator, to bank up several times or to flow in several channels beside one another.

The electrolyte can also be partially deflected along a meandering pattern.

A perforated electrode is to be understood as meaning an electrode having apertures larger than the diameter of the gas bubbles formed, so that the apertures cannot become blocked by individual bubbles. Examples of suitable electrodes are perforated plates, expanded metals, woven wire cloth or electrodes made of individual rods or strips of sheet, so-called spaghetti electrodes. Electrodes having recessed indentations in which the gas can be drawn off are also suitable. The perforated structure of the electrodes can also be so designed that the downward-flowing electrolyte is banked up several times. The electrodes can also be made of porous material.

Electrodes having a solid or perforated structure can be used as the counter-electrode. Gas diffusion electrodes are also suitable. Diaphragms or ion exchange membranes can be used as separators. The separators can have a multi-layer structure. The electrolytic cells can also be subdivided into several chambers by separators.

In the case of partitioned electrolytic cells, both sides can be operated in accordance with the suggested process, or only one side, it being then possible to operate the other side in accordance with the state of the art.

The electrodes can be flat or curved. The electrodes should have a fairly small spacing from the counter-electrode or separator, or should be more or less completely on the separator. They can also be mechanically connected to the latter. Distance pieces which are known per se can be used to fix the spacing between the electrode and the counter-electrode or between the electrode and the separator. Too great a spacing from the counter-electrode or the separator would result in an unnecessarily large throughput of electrolyte, because an ionically conducting combination of electrode and counter-electrode or electrode and separator must, of course, be achieved. The electrolyte may also flow completely or partially on the rear side of the electrode. The gas bubbles formed release their gas content into the gas space laterally adjacent to the main direction of flow by bursting at the phase boundary. In the case of plate-shaped electrodes, this is the rearward space downstream of the electrode.

Thus a phase separation takes place directly within the falling film of liquid. The droplets of electrolyte which may be entrained when the bubbles burst can be recycled to the electrode, for example by means of sheets mounted obliquely, which can also serve to supply current. The electrolyte and the gas can be drawn off individually—since they have been substantially separated. The electrolyte should run over the whole width of the electrode. The appliances required for this purpose, such as, for example, distribution grooves, are known per se.

The electrolyte can also flow between the separators, and, in special cases, also within the separators. A diaphragm can be provided between the electrode and the ion exchange membrane in order to achieve better wettability between them at a low electrolyte flow. The ion exchange membrane, the diaphragm and the electrode can be in close contact with one another. If the electrode throughput is fairly high however, it can be expedient to leave an aperture in which the electrolyte can flow between the ion exchange membrane and the diaphragm. The electrolyte thus remains substantially free from bubbles.

In electrolytic cells having several chambers, such as, for example, in the electrodialysis of sea water, in which cation and anion exchange membranes are arranged alternately, the electrolyte can also flow between these partitions.

The electrolyte can also be caused to flow downwards in a meandering pattern. This is achieved, for example, by shaping the distance pieces or the electrodes appropriately.

The electrolyte can also be made to flow down in several channels by shaping the distance pieces or electrodes appropriately.

In order that the electrode can flow at all within the meaning of the suggestion according to the invention, the electrodes and separators must be arranged so that a certain gradient to the horizontal, characterized by the angle $\alpha$, is formed. The angle $\alpha$ must be greater than 0 and less than 180°. A value of $\alpha$ greater than 90° is intended to mean that the electrolyte flows on the underside of the perforated electrode. The ionically conducting link to the counter-electrode or to the separator must then be ensured by means of capillary forces. This means that hydrophilic surfaces must be present. If an aperture between the electrode and the separator is desired, it must be small. The permissible throughput of electrolyte is also limited in this event. It is therefore more advantageous to select an angle $\alpha$ between 0 and 90°. An angle $\alpha$ of about 90° is to be preferred for reasons of simplicity and ease of survey in the construction of the equipment, particularly if the electrolytic cell is to be operated by the process according to the invention on the anode side and on the cathode side.

The process according to the invention is applicable to any electrolysis in which gas bubbles are formed in a liquid electrolyte, such as, for example:

electrolysis of alkali metal chlorides,
electrolysis of hydrochloric acid,
electrolysis of water,
electrolysis of melts and
electrolysis of chlorates.

The process according to the invention can be used in partitioned and non-partitioned electrolytic cells.

The suggested process is also suitable for secondary reactions within the electrolytic cell, for example for the preparation of propylene oxide from propylene via the halogen intermediate stage, which is known per se.

Marked advantages compared with the state of the art can be registered using as an example the electrolysis of sodium chloride:

By using the process according to the invention on both sides of an electrolytic cell partitioned by an ion exchange membrane or diaphragm, it is possible to set up a constant, very small pressure difference between the catholyte compartment and the anolyte compartment, since hydrodynamic and hydrostatic vibrations and pressure differences no longer occur.

Since gas pressures are involved, the pressures in the upper and lower parts of the electrolytic cell are virtually the same. The unintended mixing of anolyte and catholyte in the diaphragm process can therefore be reduced to a minimum. As a result of the lower mechanical stress on the electrodes and separators, it is possible to employ a finer structure for the electrodes and a thinner ion exchange membrane, which is equivalent to a reduction of the ohmic voltage drop.

Since the chafing of electrodes and separators by vibration is eliminated, the sensitive layers on the membrane and electrodes can be expected to have a longer service life. If gas diffusion electrodes are employed, loosening of the structure through vibration is prevented. As a result of the short transport path of the gas bubbles to the gas space, the gas content of the electrolyte is low, and it is virtually the same above and below, which has a favorable effect on the current distribution and the ohmic voltage drop. Since the electrolyte and the gas flow separately from one another, higher flow rates can be accomplished. This leads to a gas space only a few millimeters in depth downstream of the electrodes. It is therefore possible to construct very high and very flat cell units.

The invention will be described using FIGS. 1 to 16 as examples. Only arrangements of electrodes, separators and distance pieces are shown. The electron-conducting link to the source of current, the casing of the electrolytic cells, the lines and further similar equipment are not shown pictorially, since they are generally known. For the sake of simplicity, all the arrangements are shown at $\alpha=90°$.

BRIEF DESCRIPTION OF THE DRAWINGS

FIGS. 6, 10, 11, 12 and 13 are shown without a counter-electrode.

Figure 1:
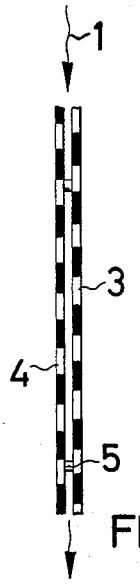
FIGS. 1, 2, 3, 14 and 15 show non-partitioned arrangements.

Two perforated electrodes 3 and 4 fixed by disk-shaped distance pieces 5 are shown in FIG. 1. Grids and filaments are also suitable for use as distance pieces 5, however. The electrolyte 1 is admitted at the upper edge of the electrodes and flows downwards, wetting both electrodes. In the course of this, part of the electrolyte 1 can also flow down on the reverse side of electrodes 3 and 4.

Figure 2:
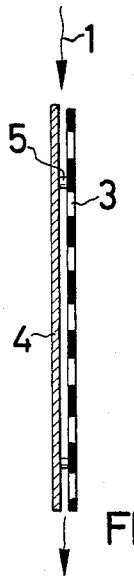
Figure 3:
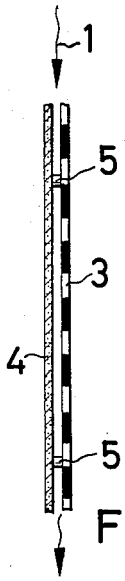

The arrangements in FIG. 2 and FIG. 3 are substantially the same as in FIG. 1. In FIG. 2, however, the electrode 4 has a solid structure. In FIG. 3 the electrode 4 comprises a gas diffusion electrode.

Figure 4:
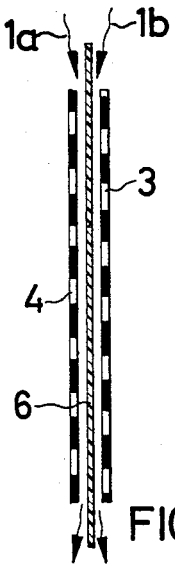
FIGS. 4, 5, 6, 7, 8, 9, 10, 11, 12, 13 and 16 show arrangements partitioned by separators.
Figure 5:
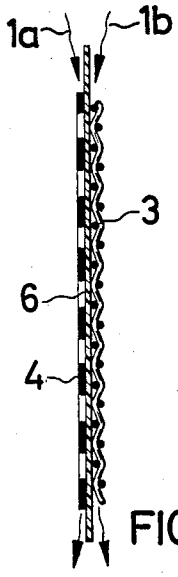
Figure 6:
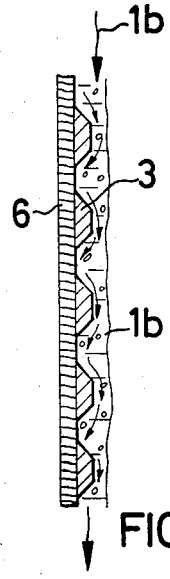

FIG. 4 shows an arrangement partitioned by a separator 6. The electrolytes 1*a* and 1*b* therefore flow in separate compartments, one electrode and the separator 6 being wetted in each case. The distance between the components 3, 4 and 6 can be fixed by distance pieces similarly to FIG. 1. In FIG. 5 the electrodes 3 and 4 bear directly on the separator 6. This case is described as zero spacing. The electrode 3 is shown as a woven wire cloth here. As a result of the perforated structure of the electrodes 3 and 4, the electrolytes 1*a* and 1*b*, which flow largely on the reverse side of the electrodes, are continually mixed and convey the gas bubbles formed to the boundary at the gas space. In FIG. 6 the electrode 3 is directly connected to the separator by mechanical means. The electrolyte 1*b* here flows entirely on the reverse side of the electrode 3.

Figure 7:
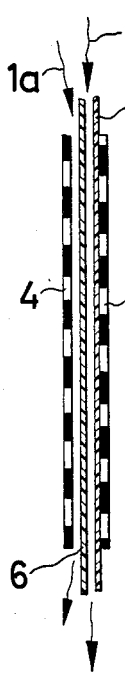

FIG. 7 shows an arrangement having two separators 6 and 2. The electrolyte 1*b* preferably flows between the separators 6 and 2, which can expediently be fixed by means of distance pieces similarly to FIG. 1. It should be noted here that the amount of electrolyte which flows in of its own accord is fixed by the geometry and the properties of the materials. Allowance must be made for this fact, for example by providing overflows at the point where the electrolyte is admitted. The electrolyte 1*b* is in contact with the electrode 3 through the separator 2, which has the form of a diaphragm. Mass transfer takes place largely through diffusion. The bubbles of gas are formed at the point of contact of the electrode 3 with the diaphragm 2, which is filled with electrolyte, and they can release their content of gas at the gas space adjoining at the side.

Figure 8:
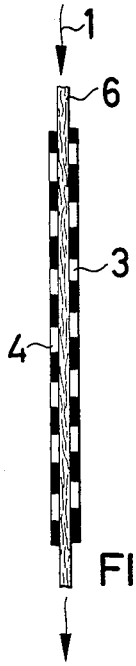

FIG. 8 shows an arrangement having a separator 6 which is so constructed that the electrolyte 1 flows down at least partially through the separator 6. The electrodes 3 and 4 bear on the separator 6. The arrangement is preferentially suitable for a low consumption of electrolyte, such as, for example, in the electrolysis of water.

Figure 9:
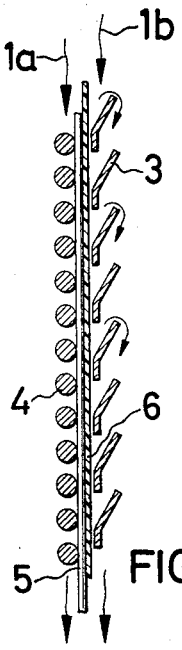

FIG. 9 shows an arrangement for a partitioned electrolytic cell in which the electrolytes 1*a* and 1*b* are banked up, at least in part, several times. Electrode 3 comprises sheet metal strips which are located in a region so close to the separator 6 that a restriction point is formed. As a result of this, part of the electrode is forced to flow over the upper edge of the sheet metal strips. A similar effect is achieved by the horizontal wires composing the electrode 4. The action of the restriction point can be adjusted by means of the distance piece 5.

Figure 10:
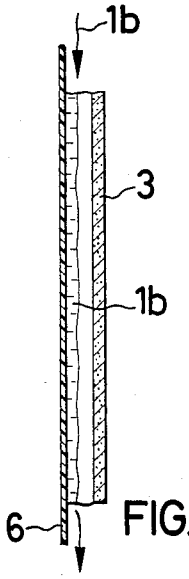
Figure 11:
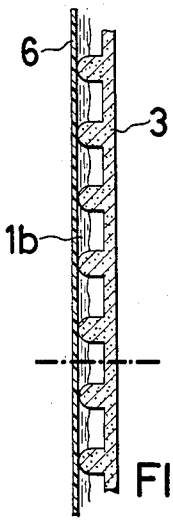

FIGS. 10 and 11 show an electrode in which the perforations are not carried through to the reverse side. FIG. 10 shows a vertical section and FIG. 11 shows a horizontal section of the same arrangement. As a result of the special construction of the electrode 3, the electrolyte 1*b* flows downwards in channels and wets the separator 6 and part of the electrode 3. The partial wetting can be achieved by making the areas of the electrode 3 adjacent to the separator 6 hydrophilic and making the more remote areas hydrophobic. Another possible means is to operate the arrangement at an angle $\alpha < 90°$. The gas space laterally adjacent to the main direction of flow of the electrolyte is in this case enclosed by the electrode 3 itself. This type of electrode can be used at the same time as a bi-polar separator.

Figure 12:
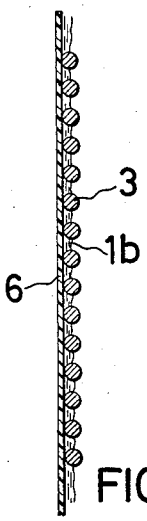

FIG. 12 shows a horizontal section of an arrangement in which the electrolyte 1*b* also flows downwards in channels. In this case the electrode 3 is constructed from wires. As shown, the electrode 3 can be partly wetted or wholly wetted.

Figure 13:
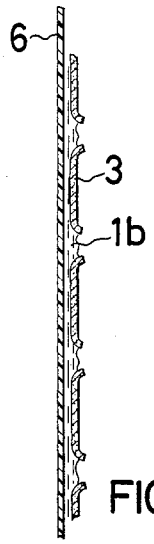

FIG. 13 also shows a horizontal section. The electrode 3 is composed of porous material and is arranged in strips placed side by side. The individual strips leave gaps through which the gas bubbles can release their content of gas into the laterally adjacent gas space. Part of the gas formed can reach this gas space through the pores of the electrode 3.

Figure 14:
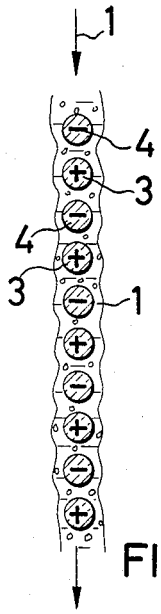
Figure 15:
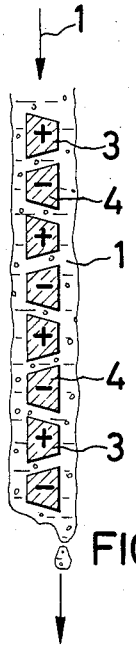

FIG. 14 shows a non-partitioned arrangement in which the electrodes 3 and 4, constructed from a large number of wires, fit into one another in the manner of a comb. Electrode and counter-electrode are, therefore, not side by side but one beneath the other. The anode is marked "+" and the cathode "−". The electrolyte 1 flows transversely to the wires. It is also possible, however, to make the electrolyte 1 flow parallel to the wires. FIG. 15 only differs from FIG. 14 in that another profile is shown instead of the wires.

Figure 16:
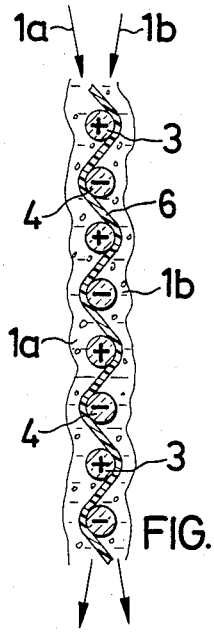

FIG. 16 shows an arrangement of electrode 3 and counter-electrode 4 which is partitioned by a separator 6 and in which the individual wires of the electrodes also fit into one another in the manner of a comb. The direction of flow of the electrolytes 1*a* and 1*b* can also be parallel to the wires.

We claim:

1. A process for the electrolysis of liquid electrolytes in which gas bubbles are formed in the electrolyte, in electrolytic cells which are non-partitioned or partitioned by at least one separator and in which at least one electrode is perforated, which comprises causing the electrolyte to flow by means of gravity through the electrolytic cell in such a manner that a gas space is formed laterally to the main direction of flow of the electrolyte.

2. The process as claimed in claim 1, including two electrodes and wherein the electrolyte is caused to flow in such a manner that both electrodes are wetted.

3. The process as claimed in claim 1, wherein the electrolyte is caused to flow in such a manner that the perforated electrode and a separator are wetted.

4. The process as claimed in claim 1, wherein the electrolyte is caused to flow in such a manner that the separators are wetted.

5. The process as claimed in claim 1, wherein the electrolyte is caused to flow at least partially through the separator.

6. The process as claimed in claim 1, wherein the electrolyte is caused to flow in such a manner that it is reversed several times.

7. The process as claimed in claim 1, wherein the electrolyte is caused to flow in several channels side by side.

8. The process as claimed in claim 1, wherein the electrolyte is deflected and flows in a meandering pattern.

* * * * *